US008322576B2

(12) United States Patent
Gioia

(10) Patent No.: US 8,322,576 B2
(45) Date of Patent: Dec. 4, 2012

(54) SPRAY BOTTLE RESERVOIR SYSTEM

(76) Inventor: Constantine M. Gioia, Sumter, SC (US)

( * ) Notice: Subject to any disclaimer, the term of this patent is extended or adjusted under 35 U.S.C. 154(b) by 322 days.

(21) Appl. No.: 12/662,569

(22) Filed: Apr. 23, 2010

(65) Prior Publication Data

US 2010/0270334 A1 Oct. 28, 2010

Related U.S. Application Data

(60) Provisional application No. 61/213,002, filed on Apr. 27, 2009.

(51) Int. Cl.
*B67D 7/58* (2010.01)

(52) U.S. Cl. ..... 222/377; 222/382; 222/383.1; 222/464.7

(58) Field of Classification Search ..... 222/377, 222/323–324, 321.5, 464.7, 129, 464.1, 382, 222/383.1; 239/302, 333, 349, 360, 525
See application file for complete search history.

(56) References Cited

U.S. PATENT DOCUMENTS

| | | | | |
|---|---|---|---|---|
| 847,760 | A * | 3/1907 | Gates | 222/325 |
| 1,530,074 | A * | 3/1925 | Eckert | 222/341 |
| 2,002,635 | A * | 5/1935 | Kinney | 222/209 |
| 2,583,821 | A * | 1/1952 | Du Bois | 239/327 |
| 5,279,450 | A | 1/1994 | Witt, Jr. | |
| 5,518,150 | A * | 5/1996 | Witt, Jr. | 222/377 |
| 6,871,760 | B1 | 3/2005 | Snider | |
| 7,055,722 | B2 * | 6/2006 | Ouellette | 222/454 |
| 7,520,447 | B2 * | 4/2009 | Engelen et al. | 239/302 |
| 2005/0167527 | A1 * | 8/2005 | Iiood et al. | 239/302 |
| 2007/0056995 | A1 * | 3/2007 | Cotter | 222/377 |
| 2007/0233012 | A1 | 10/2007 | Lerrick et al. | |
| 2007/0241139 | A1 * | 10/2007 | Shade | 222/464.7 |

FOREIGN PATENT DOCUMENTS

| | | |
|---|---|---|
| JP | 10337510 | 12/1998 |

* cited by examiner

*Primary Examiner* — Frederick C. Nicolas
(74) *Attorney, Agent, or Firm* — Richard C. Litman

(57) ABSTRACT

The spray bottle reservoir system includes a bottle having a neck and a body, the body defining a main chamber for containing fluid. A spray cap is detachably mounted to the neck. A vertical partition is disposed inside the body, separating the main chamber to form a dispensing reservoir. A dip tube extends from the spray cap to the bottom of the dispensing reservoir. The dispensing reservoir may be refilled from the remaining chamber, and due to the relative small volume of the dispensing reservoir and the viscosity of the fluid, the dispensing reservoir permits maximum consumption of the fluid in a wide range of spraying positions.

3 Claims, 6 Drawing Sheets

SPRAY BOTTLE RESERVOIR SYSTEM

CROSS-REFERENCE TO RELATED APPLICATION

This application claims the benefit of U.S. Provisional Patent Application Ser. No. 61/213,002, filed Apr. 27, 2009.

FIELD OF THE INVENTION

The present invention relates to fluid dispensers, more specifically, to a spray bottle reservoir system configured to maximize usage of the fluid therein.

DESCRIPTION OF THE RELATED ART

Spray bottles or fluid dispensers are convenient devices for dispensing fluids for cleaning, gardening, pest control and a variety of other daily chores or activities. One of the main concerns with spray bottles relates to the efficient consumption of the liquid stored therein. Most conventional spray bottles include a spray cap detachably mounted to the neck of a bottle with a dip tube or source line extending from the spray head into the body of the bottle. The fluid inside the bottle is pumped or drawn through the dip tube and out of the nozzle of spray head. While these conventional bottles work well to dispense the fluid, they do not consume the last couple of ounces or dregs from the bottom of the bottle due, in part, to the dip tube not being capable of reaching the remaining fluid, e.g., the tube is not long enough and/or the placement of the tube inside the bottle is not ideal for extraction of the remaining fluid. For budget minded consumers, that is a potential financial loss over time. In addition, these bottles with the remaining fluid are often discarded, which creates additional and avoidable waste.

Some solutions have been proposed to resolve the above problem by having a sloping surface inside the bottle chamber whereby the dip tube normally resides at the bottom of the slope, where a majority of the fluid rests. However, such a configuration limits the range of orientations for the user to effectively utilize the contained fluid. Thus, it would be beneficial in the art to have a bottle configured so that a substantial majority or all of the fluid can be dispensed in a wide range of working orientations of the bottle.

Thus, a spray bottle reservoir system solving the aforementioned problems is desired.

SUMMARY OF THE INVENTION

The spray bottle reservoir system includes a bottle having a neck and a body, the body defining a main chamber for containing fluid. A spray cap is detachably mounted to the neck. A vertical partition is disposed inside the body, separating the main chamber to form a dispensing reservoir. A dip tube extends from the spray cap to the bottom of the dispensing reservoir. The dispensing reservoir may be refilled from the remaining chamber and, due to the relative small volume of the dispensing reservoir and the viscosity of the fluid, the dispensing reservoir permits maximum consumption of the fluid in a wide range of spraying positions.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
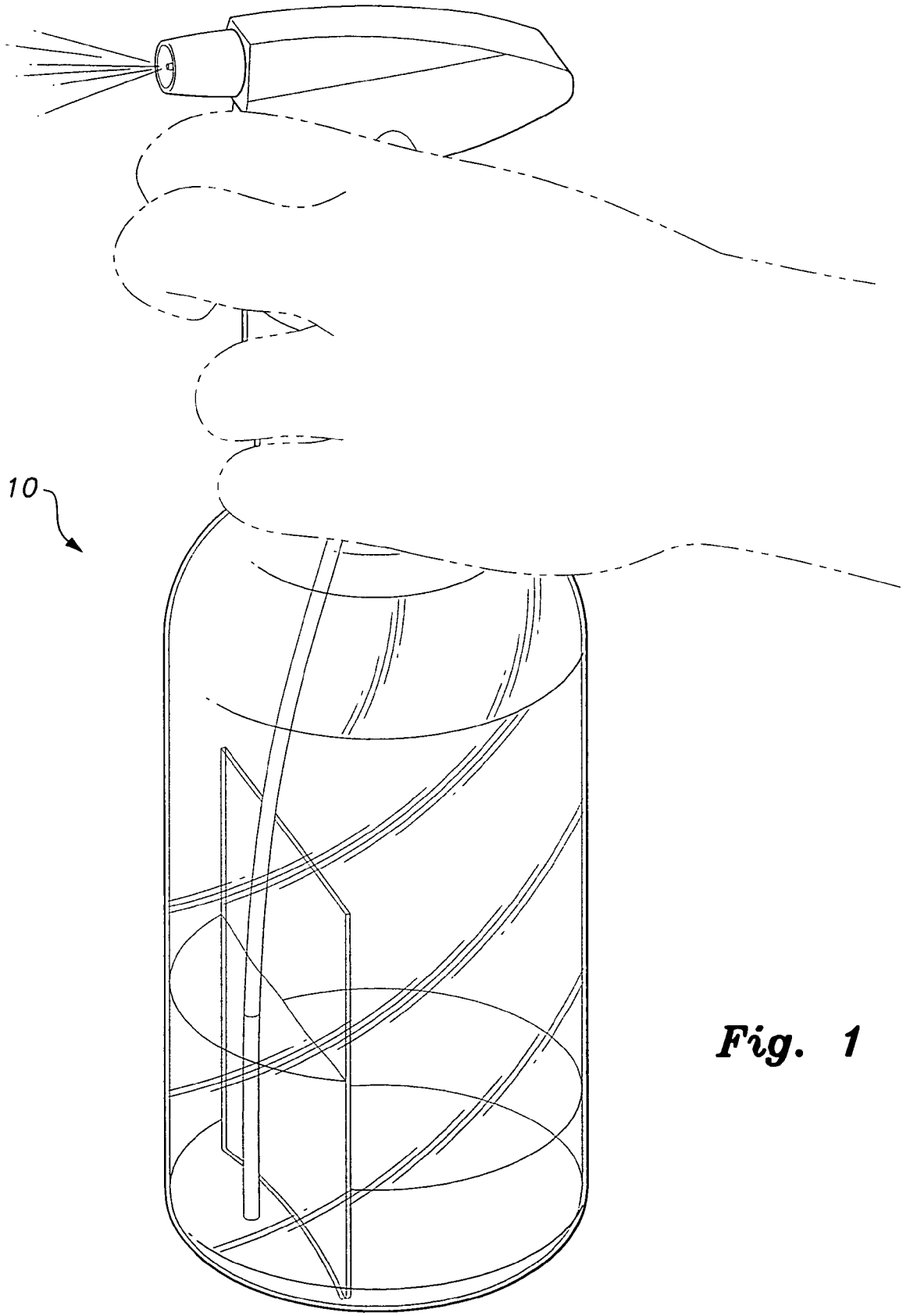
FIG. 1 is an environmental, perspective view of a spray bottle reservoir system according to the present invention.
Figure 2:
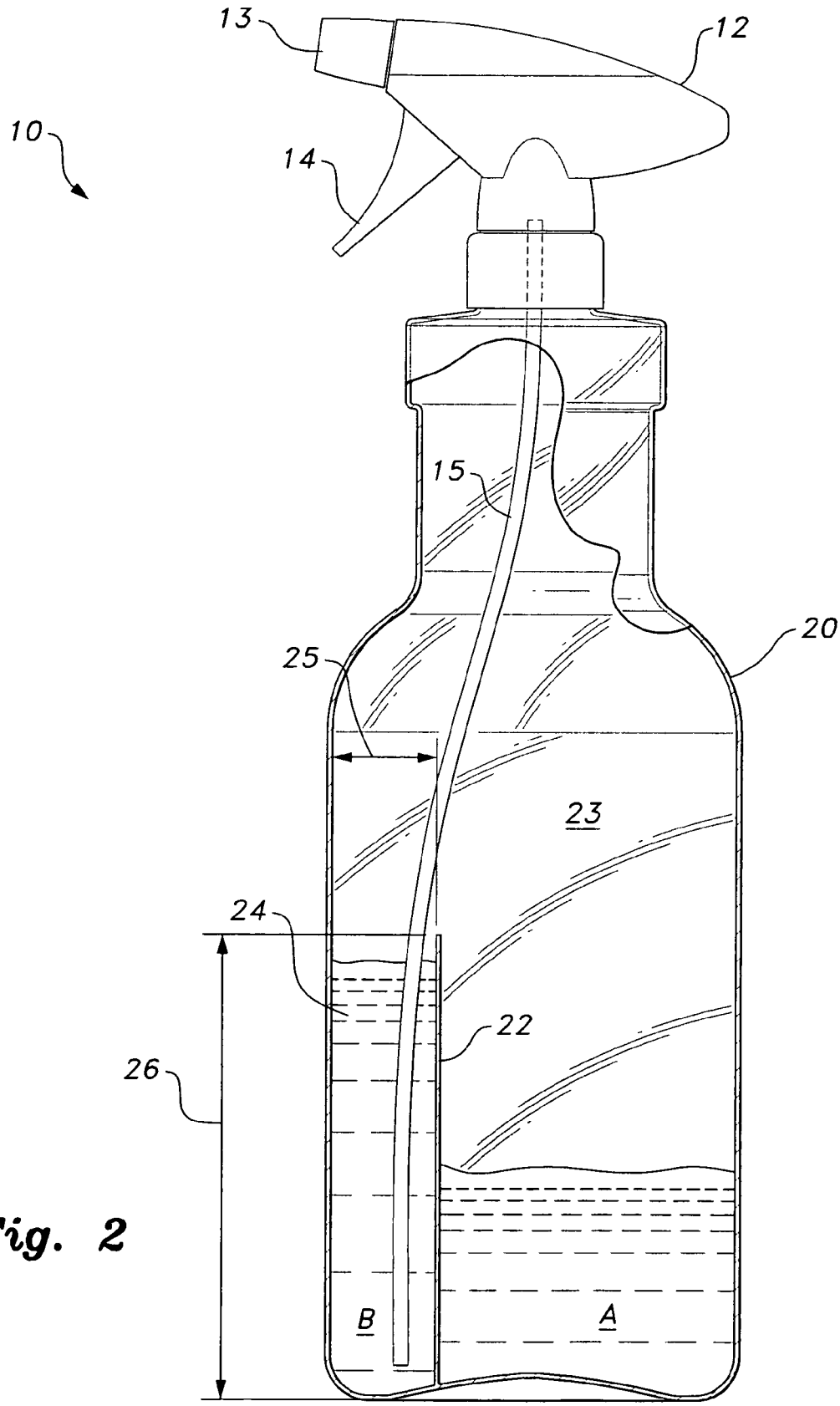
FIG. 2 is a side view in section of the spray bottle reservoir system of FIG. 1.

The present invention relates to a spray bottle reservoir system 10 with features that permit maximum consumption of the dispensing fluid contained in the bottle in a wide range of spraying positions. Referring to FIGS. 1 and 2, the spray bottle reservoir system 10 includes a spray head or cap 12 attached to the neck of a bottle 20. The spray cap 12 includes a nozzle 13 through which fluid or liquid A, B is dispensed. A source or dip tube 15 extends from the spray cap 12 into the main chamber 23 of the bottle, and the trigger 14 pumps the fluid A, B to be sprayed out the nozzle 13.

To maximize consumption of the fluid A, B, the spray bottle reservoir system 10 includes a vertically oriented partition or wall 22 disposed in the interior main chamber 23, dividing the main chamber and forming a dispensing reservoir 24. The volume of the dispensing reservoir 24 is relatively smaller than the overall volume of the bottle or container 20, and the dispensing reservoir volume may be varied by changing the height 26 and/or the lateral position 25 of the partition 22. Exemplary height 26 of the partition 22 may range from 0.5-6.0 in., and the exemplary lateral position 25 may range from 0.5-1.5 in. Other dimensions are also possible, depending on the requirements of the user or manufacturer. The dip tube 15 extends into the dispensing reservoir 24 and draws the fluid B contained therein. As the fluid B is emptied during use, the dispensing reservoir 24 may be replenished by tilting the spray bottle reservoir system 10 forward, i.e., to the left in the orientation shown in FIG. 2, so that the residual fluid A may flow into the reservoir 24. The viscosity of the fluid A, B and the smaller volume of the reservoir 24 combined ensure maximum use of the fluid A, B.

Figure 3:
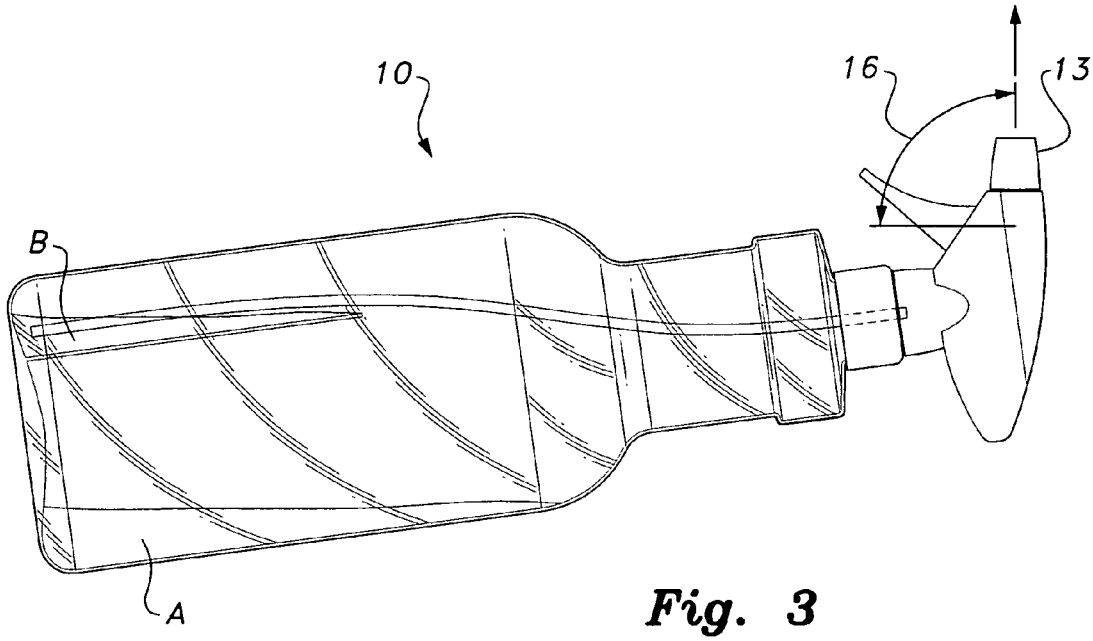
FIG. 3 is a side view of the spray bottle reservoir system of FIG. 1 at one extreme spraying position.
Figure 4:
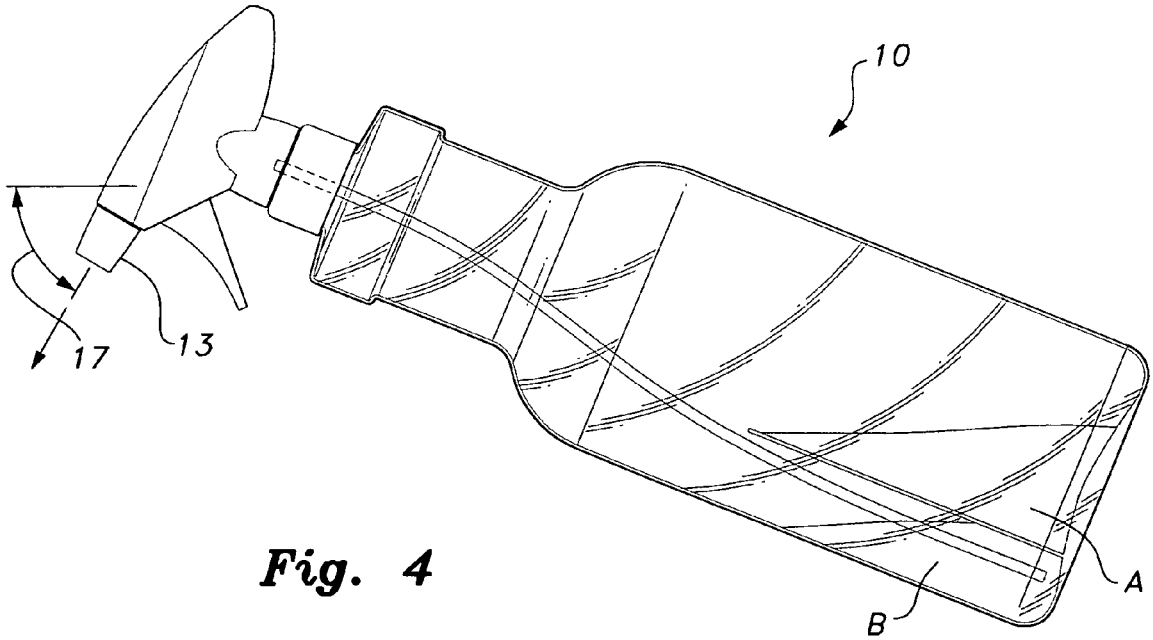
FIG. 4 is a side view of the spray bottle reservoir system of FIG. 1 at another extreme spraying position.

While the above works well in the position shown in FIG. 2, the spray bottle reservoir system 10 also performs well and maximizes fluid usage in a wide range of positions normally employed to spray fluid. For example, as shown in FIG. 3, the nozzle 13 is pointing in the 12 o'clock or 90° from horizontal position 16 to spray fluid B. Even at this angle, the viscosity of the fluid B in the reservoir 24 is sufficient to cling to the surrounding walls and keep the fluid B contained therein. The effect is enhanced by the small volume of the reservoir 24. Similarly as shown in FIG. 4, the nozzle 13 is pointing in the 7 o'clock or 60° from horizontal position 17. Due to the combined effects of viscosity and small volume of the reservoir 24 mentioned above, the spray bottle reservoir system 10 is capable of dispensing fluid B with maximum consumption at position 17.

Figure 5:
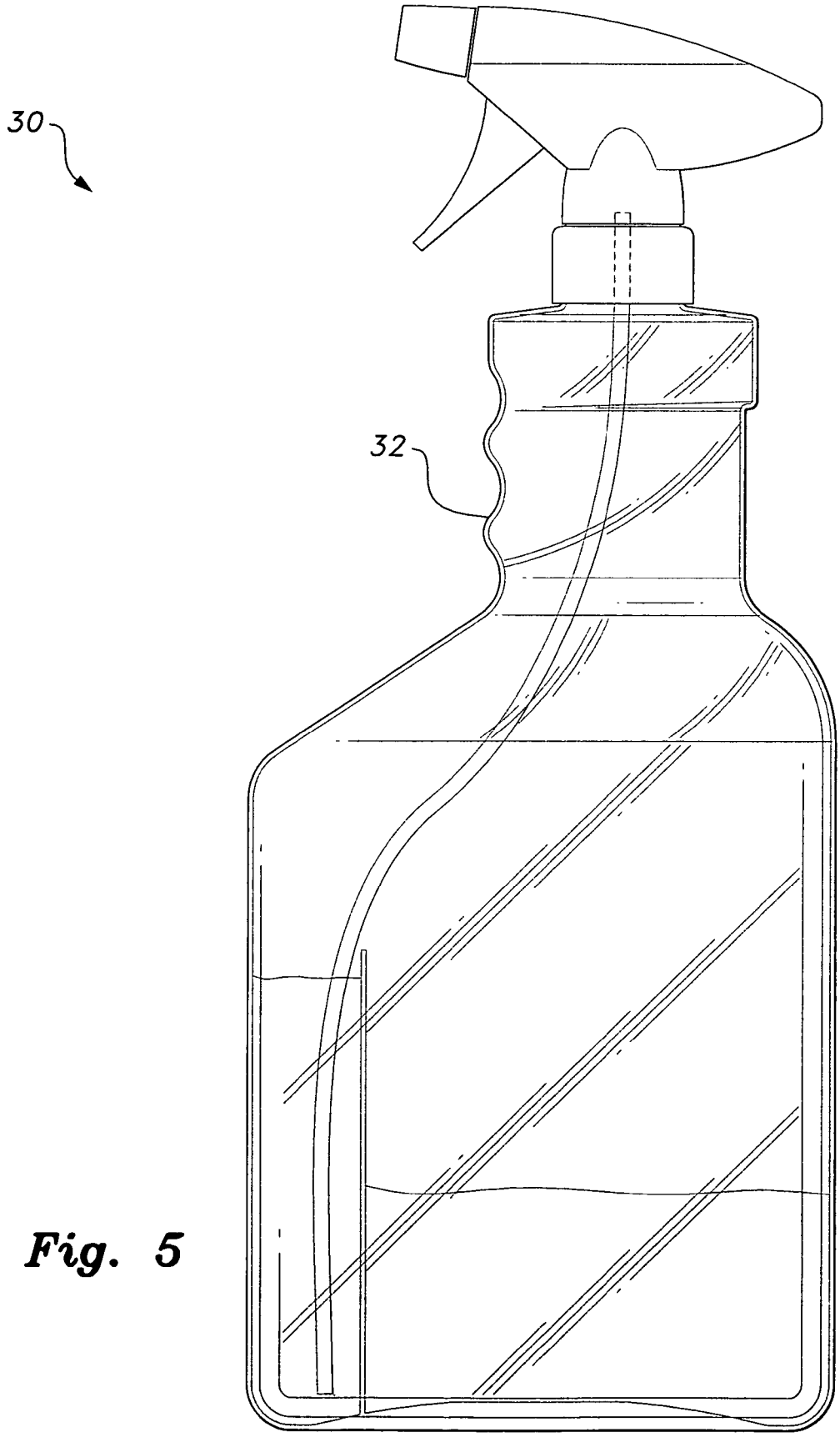
FIG. 5 is a side view of an alternative embodiment of a spray bottle reservoir system according to the present invention
Figure 6:
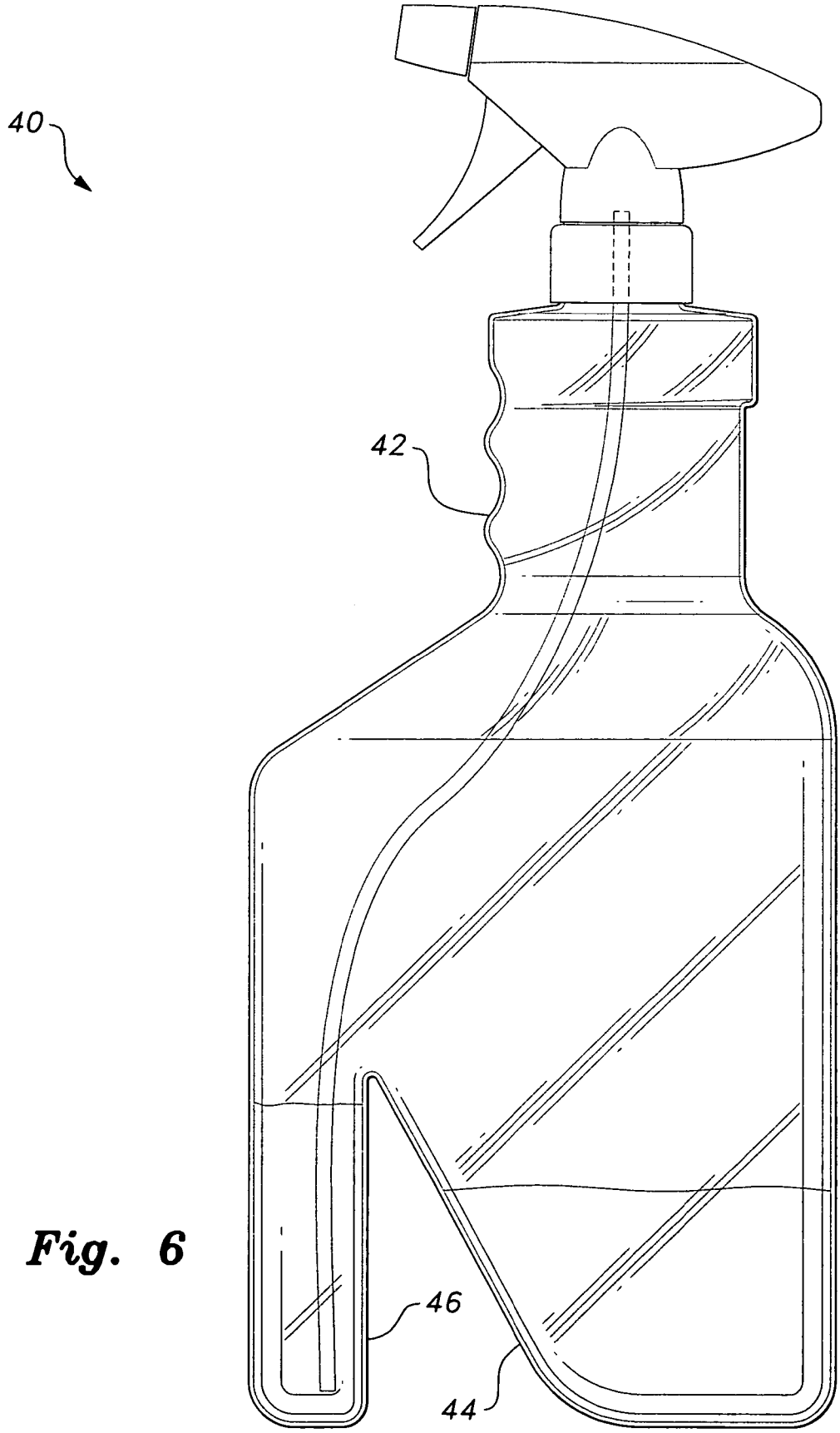
FIG. 6 is a side view of another alternative embodiment of a spray bottle reservoir system according to the present invention.

FIGS. 5 and 6 disclose examples of alternative spray bottle reservoir systems. In FIG. 5, the spray bottle reservoir system 30 includes a bottle or container having an ergonomic grip 32 formed on the neck portion of the bottle. This system 30 has a larger capacity compared to system 10. In FIG. 6, the spray bottle reservoir system 40 also includes an ergonomic grip 42 formed at a neck portion of the bottle or container. Moreover, the lower portion of the bottle includes an angled notch or crest indention defined by walls 44, 46 to form a dispensing reservoir. The sloping wall 44 permits easier flow of fluid into the reservoir, forming a ramp when the container is tilted to refill the dispensing reservoir. Both of the above examples function in substantially similar manner to the spray bottle reservoir system 10.

Figure 7:
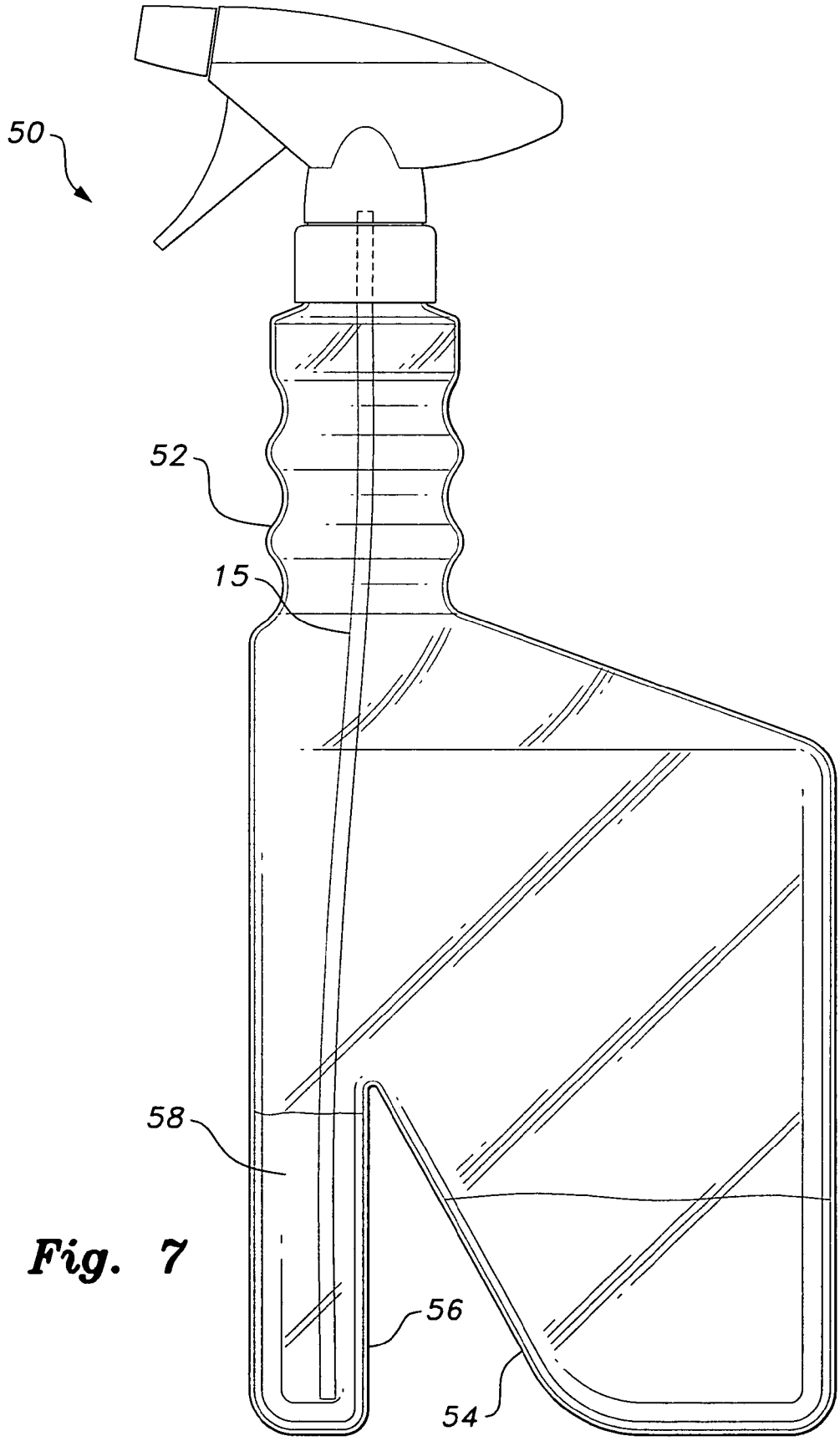
FIG. 7 is a side view of a further alternative embodiment of a spray bottle reservoir system according to the present invention.

FIG. 7 discloses a further alternative spray bottle reservoir system 50. The spray bottle reservoir system 50 includes a bottle or container having an ergonomic grip 52 formed on the neck portion of the bottle. In this embodiment, the ergonomic grip 52 has contours all around the neck of the bottle, providing a universal gripping surface so that the bottle can be held in any direction. In addition, the cap 12 can be positioned in different directions to reach difficult areas while maintaining a comfortable and firm grip. The lower portion of the bottle also includes an angled notch or crest indention defined by walls 54, 56 to form a dispensing reservoir. The sloping wall 54 permits easier flow of fluid into the reservoir, forming a ramp when the container is tilted to refill the dispensing reservoir. Moreover, the main chamber is shifted so that the dip tube 15 is straight and in direct line with the dispensing reservoir 58. This eases insertion of the dip tube 15 into the dispensing reservoir 58 by the user, as well as in manufacture, since no special manipulation of the dip tube 15 or design will be required.

It is noted that the spray bottle reservoir system 10 may encompass a variety of alternatives in addition to those mentioned above. For example, the bottle 30 may be made from metal, plastic, glass or any other sturdy material. The bottle 20 may be transparent or translucent or it may include a means whereby a user may see how much fluid is contained in the reservoir 24, main chamber 23 or both. The bottle 20 may also include indicia for measurement, advertising, labels, messages and/or personal identification.

It is to be understood that the present invention is not limited to the embodiments described above, but encompasses any and all embodiments within the scope of the following claims.

I claim:

1. A spray bottle reservoir system, comprising:

a container having a neck and a body, the body defining a main chamber having a volume for containing fluid;

a spray cap detachably mounted to the neck;

a vertical partition disposed inside the body, the partition separating the main chamber to form a dispensing reservoir, the dispensing reservoir having a volume smaller than the volume of the main chamber, the dispensing reservoir being refillable with residual fluid from the main chamber, wherein the partition is formed by an indention formed in a lower portion of the container body, the indention having a vertical wall defining a portion of the dispensing reservoir and a sloping wall extending away from the vertical wall to separate fluid remaining in the main chamber from fluid in the dispensing reservoir, the sloping wall forming a ramp to facilitate refilling the dispensing reservoir when the container body is tilted; and a dip tube extending from the spray cap to the bottom of the dispensing reservoir, the dispensing reservoir maximizing consumption of the fluid therein in a wide range of spraying positions.

2. The spray bottle reservoir system according to claim 1, wherein said neck forms an inlet and said dip tube is straight and in line from the inlet to the bottom of the dispensing reservoir, the dispensing reservoir being axially aligned with the inlet.

3. The spray bottle reservoir system according to claim 1, wherein the partition has a height ranging from 0.5-6.0 in.

* * * * *